US005500574A

United States Patent [19]

Popov et al.

[11] Patent Number: 5,500,574

[45] Date of Patent: Mar. 19, 1996

[54] INDUCTIVELY COUPLED SUBSTANTIALLY FLAT FLUORESCENT LIGHT SOURCE

[75] Inventors: Oleg Popov, Needham; Jakob Maya, Brookline, both of Mass.

[73] Assignee: Matsushita Electric Works R&D Laboratory, Inc., Woburn, Mass.

[21] Appl. No.: 313,760

[22] Filed: Sep. 28, 1994

[51] Int. Cl.[6] ..... H05B 41/16

[52] U.S. Cl. ..... 315/248; 315/246; 313/573; 313/634; 313/160; 313/161

[58] Field of Search ..... 315/248, 246, 315/242, 356, 258; 313/573, 489, 634, 160, 161

[56] References Cited

U.S. PATENT DOCUMENTS 4,245,179 1/1981 Buhrer ..... 315/248

4,266,167 5/1981 Proud et al. ..... 315/248

*Primary Examiner*—Robert J. Pascal
*Assistant Examiner*—Reginald A. Ratliff
*Attorney, Agent, or Firm*—Jerry Cohen

[57] ABSTRACT

Electrodeless, low pressure, fluorescent discharge lamp of high aspect ratio, with a substantially flat spiral rf coil adjacent a back face (and insulated therefrom), that emits light through a front surface or selected portions under control of internal reflective and phosphor coatings placement to afford minimum resonance trapping, high efficiency and uniform illumination of high specific intensity over a selected area of the front wall.

9 Claims, 6 Drawing Sheets

INDUCTIVELY COUPLED SUBSTANTIALLY FLAT FLUORESCENT LIGHT SOURCE

BACKGROUND OF THE INVENTION

This invention relates to electrodeless low pressure mercury rare gas discharge lamps. Such devices comprise a glass lamp vessel filled with a rare gas or rare gas mixture and a mercury or other vapor dose, then sealed under vacuum conditions. The walls of the vessels are partially coated with a high reflectivity material such as $Al_2O_3$ on top of which a layer of phosphor mix is deposited. An external spiral coil is used to initiate and maintain a discharge in the lamp. Electrodeless low pressure mercury rare gas discharge lamps containing a phosphor layer have been disclosed before as long life fluorescent lamps.

1. References:

(a) J. M. Anderson, "High Frequency Electrodeless Fluorescent Lamp Assembly", U.S. Pat. No. 3,521,120 of Jul. 21, 1970; (b) J. M. Anderson, "Electrodeless Fluorescent Lamp Bulb RF Power Energized Through Magnetic Core Located Partially Within Gas Discharge Space". U.S. Pat. No. 3,987, 335 of Oct. 19, 1976; (c) D. D. Hollister, "Light Generation by an Electrodeless Fluorescent Lamp", U.S. Pat. No. 4,010, 400 of Mar. 1, 197; (d) J. M. Proud and R. K. Smith, "Compact Fluorescent Light Source Having Metallized Electrodes", U.S. Pat. No. 4,266,166 of May 5, 1981; (e) H. Houkes, J. W. Denneman, P. Postma, "Discharge Lamp With Interference Shielding", U.S. Pat. No. 4,568,859 of Feb. 4, 1986; (f) H. Houkes, P. Postma, and A. C. van Veghel, "Electrodeless Low Pressure Discharge Lamp". U.S. Pat. No. 4,710,678 of Dec. 7, 1987; and (g) P. Postma and A. C. van Veghel, "Electrodeless Low Pressure Discharge Lamp". U.S. Pat No. 4,727,295 of Feb. 23, 1988. Many of these lamps comprise an incandescent light bulb which has a coil of some number of turns either inside or outside the bulb. The operating frequency of such a lamp typically is in the MHz range with many of them operating at 13.56 MHz. These lamps typically are distinguished by the fact that they tend to be longer living compared to electroded-version-compact or otherwise fluorescent devices and they need some provision to reduce the electromagnetic interference (EMI) to levels acceptable to the various regulatory agencies around the world. None of these disclosures, however, anticipate a use where the lamp is as thin as possible, and it gives off light in a specific direction for increased effectiveness of illumination.

In the prior art the inductively coupled plasma generated by a solenoid coil forms a ring with the azimuthal symmetry but strongly non-uniform in the radial and axial directions. The bulb typically has a shape of the incandescent lamp and has a spherical symmetry. As a result, the light illumination is predominantly in the radial direction, while the light illumination through the top and the bottom of the bulb is much weaker. This radial and axial light illuminance non-uniformity is the inherent feature of the lamp described in prior patents cited herein (at n. 1) and makes these types of lamp somewhat less than optimum for directional light illumination.

The coil inserted inside the reentrant cavity is subjected to the extensive heat from the plasma generated at the adjacent walls. This heating of the coil results in the increase of its temperature and hence in the rise of the coil resistance. This causes an increase of RF power losses in the coil, $P=I^2R$, that reduces lamp efficiency. The thermal management of the coil is one of the major problems in the design of lamps with high light illumination (greater than 3000 lumens) which requires RF power, P>50 W.

Prior art electrodeless lamp disclosures (including those cited at n. 1) describe lamps with reentrant cavities employ a bulb shape close to the classic incandescent lamp bulb shape. As a result of this design, the distance between the wall of the reentrant cavity is a few centimeters. This is a relatively long path for the mercury resonance line generated primarily near the outer walls of the reentrant cavity. Such a path results in resonance line trapping and hence reduces the radiation efficiency.

It is an objective of this invention to provide an electrodeless flat lamp energized inductively with a spiral shaded coil adjacent to one of the surfaces of the lamp and coupling RF power efficiently to the lamp gas mixture.

It is another objective of this invention to provide a flat or substantially flat lamp with uniform illumination in such a manner that it requires either a very small and inexpensive fixture or no fixture at all for general illumination, either in downlights or sconce (wall) lighting or some other accent lighting.

Another objective is to provide an efficient substantially flat lamp with as little resonance trapping as possible so as to increase the brightness density across its surface.

A further objective is to provide as compact a package as possible by having a very thin lamp that has uniform brightness.

Yet a further objective is to provide a lamp whose emission is mostly directed in one dimension thereby increasing its effectiveness in illuminating that particular dimension.

A further objective is to provide an electrodeless light source in which the spatial distribution of light can be altered at will, in any given direction.

SUMMARY OF THE INVENTION

According to the present invention a glass bulb substantially flattened where one dimension (an average or minimum areal dimension) far exceeds the other (the height of the vessel), i.e. has a high aspect ratio, is filled with a mixture of rare gases or pure rare gas at pressures ranging from 0.01 to 10–15 torr, depending on the application and a small amount of mercury. The walls of this flattened vessel are coated with phosphor of the kind typically found in most compact fluorescent lamps (CFL's). In order to direct the majority of the visible radiation in the forward direction (see FIG. 2 and related discussion below) the inside of a back surface (interior of a back wall portion), underneath the phosphor a visible or a visible and UV reflecting layer is applied. This reflects all the visible light in the forward direction increasing the brightness of the light source and resulting in a high brightness apparent-surface-radiation-source.

This lamp differentiates itself from the prior art by the absence of a reentry cavity and the shape and structure of the coil as described herein. As a result of such structural differences, substantial functional advantages result as described herein.

One of the unique features of this invention is that the lamp can be operated at a higher ambient temperature than normal tubular fluorescent lamps. This is because of the following: If fluorescent lamps are operated at a higher temperature than optimum ambient temperature (typically 25° C. which corresponds to a mercury cold spot temperature of typically 40° C.) then mercury radiation is imprisoned and cannot escape as efficiently. Therefore typically fluorescent lamps operating in small fixtures do not yield as high efficiency. In order to increase the light output, fixture size is increased so as to reduce the heat buildup and reduce the ambient temperature. However, this is expensive and leads to relatively large and bulky fixtures.

In the present invention the distance ultraviolet photons have to travel is relatively small (a couple of cm's due to the high aspect ratio) therefore the temperature can be increased further without adverse effects on the performance of the light source. Since the ambient temperature can be higher now, the fixture can be made smaller, resulting in an overall less expensive and higher performance system.

Therefore, in this invention, we provide a lamp configuration and a way to energize it which we believe is novel and has many potential applications in general illumination that require high brightness, high efficiency, long life, uniform appearance and a compact size. The fact that the source is very effective in directional illumination makes for a high efficiency and relatively inexpensive fixture design. Applications of this nature are recessed or protruding downlighting, wall and sconce lighting for corridor illumination in hotels, motels, accent illumination of corners or offices or residential situations, etc.

Briefly, the fundamental differences between the light sources described in the references cited at note 1 and the present invention lies in:

Geometry of the bulb

Type, shape, size, and location of the inductive coils

Directionality of the light emission

Applications for which the lamp would be appropriate.

Also worthy of discussion (and comparison) is U.S. Patent 4,245,179, (h) C. F. Buhrer, "Planar Electrodeless Fluorescent Light Source", U.S. Pat. No. 4,245,179 of Jan. 13, 1981. That patent describes a planar electrodeless fluorescent light source operated at frequencies 1–100 MHz. The text and eleven claims of the patent explicitly describe a light source having two parallel planar light illuminating (glass) plates. This is a key feature of this patent which differentiates it from the present invention which has an illuminating surface of arbitrary shape and is not limited by the requirement of the two planar parallel plates. Flat plates result in a heavy light source because glass thickness has to be large enough to withstand the atmospheric pressure. In addition, due to a thick layer of glass, visible light absorption increases resulting in a less efficient light source. The other object of the said patent is the suppression of the electromagnetic radiation (reduction of the EMI). This is believed to be achieved by the use of induction coil (coils) of special design and special arrangement (symmetrical coils position, coils separation). The third object of the '179 patent is the uniform width between the two plates. Though the width is not specified in the claims, one example is given in the Description of the Preferred Embodiments, as one cm.

The above mentioned features of the '179 patent determined the specific structure, shape, and positions of the induction coils, and even determined the number of loops symmetrically located in one or two planes parallel to the two lamp illuminating plates. The RF coils, shown in cross section, depict the coils following the form of the back B of each lamp. The form is convex in FIGS. 2A and 2C, flat in FIG. 2B and concave in FIG. 2D. Each pair of adjacent loops had currents flowing in the opposite direction that resulted in the suppression of the far field radiation. The requirement of "loop-based" induction coil made the coil design in the '179 patent fundamentally different from the present invention which employs the spiral type coil having arbitrary number of turns and arbitrary shape: e.g. flat, concave, convex, cone shaped, flare shaped, etc.

Another important feature of the '179 patent is that light is illuminated through both parallel glass plates which form the lamp envelope. The patent's specification text and claims teach that the inner surfaces of the two parallel radiative plates are coated only with phosphor. In the present invention, the radiating area comprises a portion of the total glass envelope. It can be the part of the top surface, bottom, or the side of the glass envelope for directional illumination applications. It can also have any size and shape aperture free of phosphor while the rest of the surfaces being coated with a reflecting coating such as $Al_2O_3$ and phosphor. This is the fundamental difference between the present invention which has directional illumination, and the '179 patent which radiates through both parallel illuminating glass plates in opposite directions. Different coating arrangements are dictated by the requirements of the different applications.

The present invention does not need two flat plates attached to each other and the coils do not have to be placed in a particular arrangement so as to reduce the far field electromagnetic emission. The front wall (wall which appears to the viewer to be the light source) is completely free of any kind of coil and the present invention allows emission of as much light as possible through the front wall for directional illumination. The invention achieves the further object, mentioned above, i.e. to reduce the resonance trapping as much as possible and to operate the lamp in elevated ambient temperatures without loss of performance output.

The present invention includes, preferrably, use of a substantially flat pancake type coil placed in the back of the light source. This does not block any radiation because there is almost no radiation coming through the back surface and therefore it is not an obstruction. As mentioned above, all the radiation is directed forward and the particular coil arrangement of a spiral or a single turn or several turns in no way infringes upon the Buhrer patent where there is a very specific arrangement of the excitation coil to make the light source work.

The present invention differs, then, from the '179 patent on the basis of:

1. lamp construction;
2. coil design and arrangement;
3. coating composition and arrangement;
4. fields of applications of light sources.

Other objects, features and advantages will be apparent from the following detailed description of preferred embodiments taken in conjunction with the accompanying drawings in which:

BRIEF DESCRIPTION OF THE DRAWINGS

FIG. 5, a trace of light output vs. power, gives the light output as a function of coupled RF power for a 10 cm. diameter 1.5 cm. thick lamp;

FIG. 6 gives the relative illuminance versus ambient temperature for an 8 cm. diameter 1.5 cm. thick flat lamp; and FIG. 7 gives the radial distribution of relative illuminance for an 8.5 cm. diameter 1.5 cm. pancake type of flat.

DESCRIPTION OF PREFERRED EMBODIMENTS OF THE INVENTION

Figure 1A:
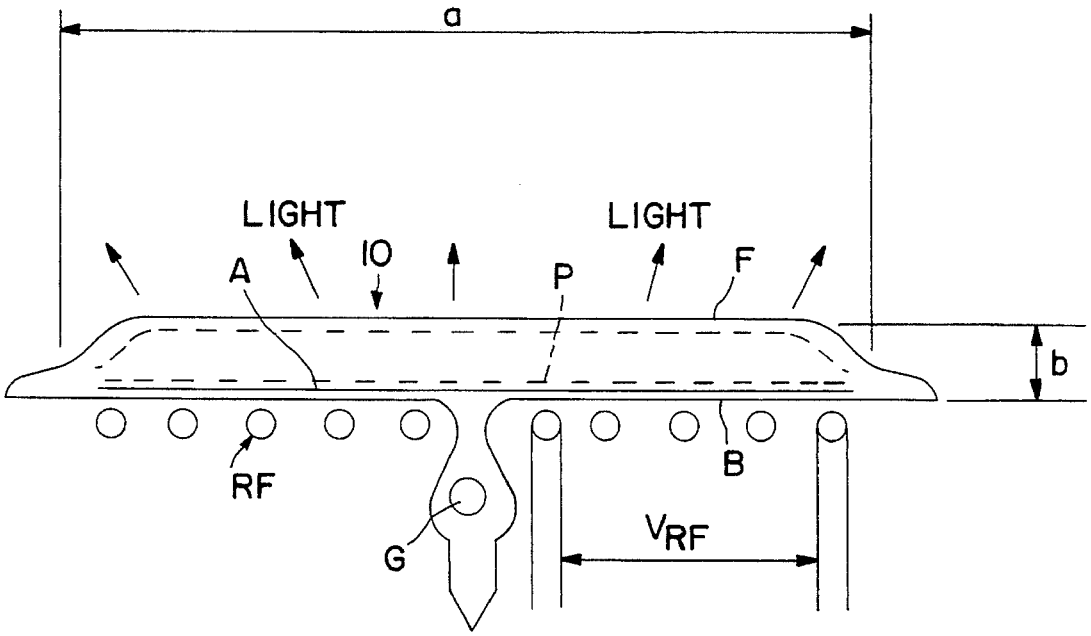
FIG. 1A shows a cross section view and FIG. 1B shows a "back" view of an inductively coupled, substantially flat fluorescent lamp utilizing a spiral coil.
Figure 1B:
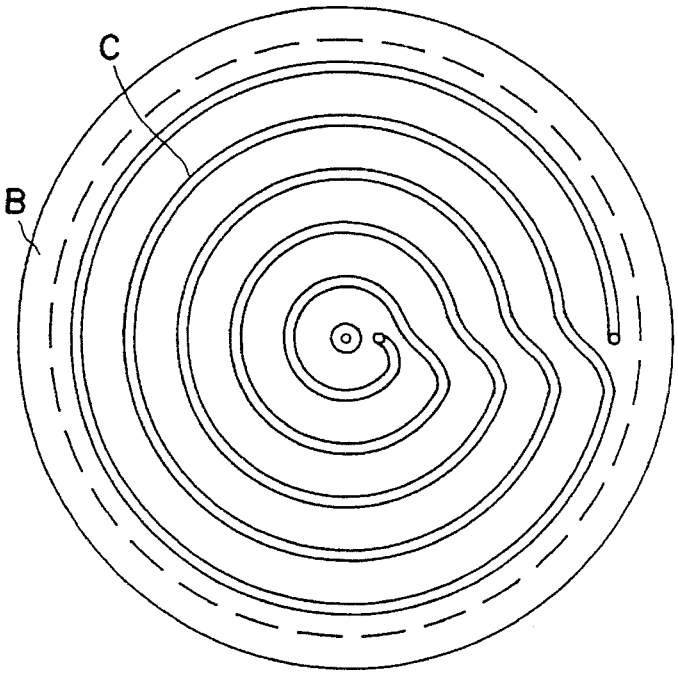
Figure 2A:
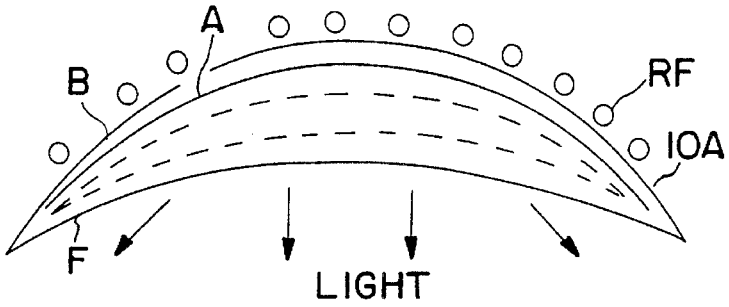
FIGS. 2A–2D show the various possible side view configurations of a flat circular lamp that could be used in accordance to preferred embodiments of general illumination of backlighting applications.
Figure 2B:
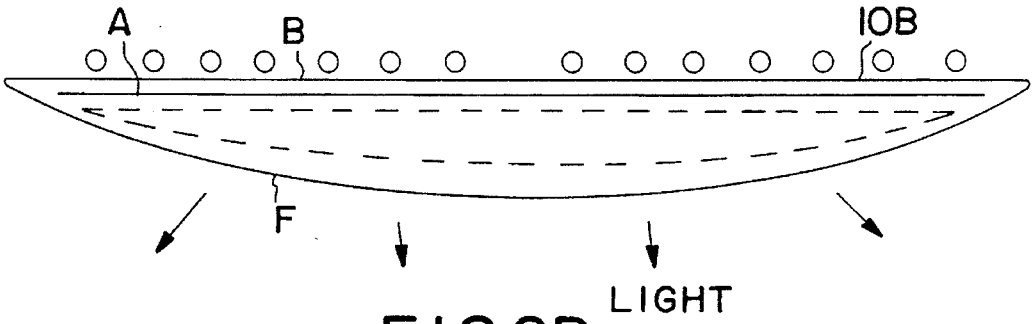
Figure 2C:
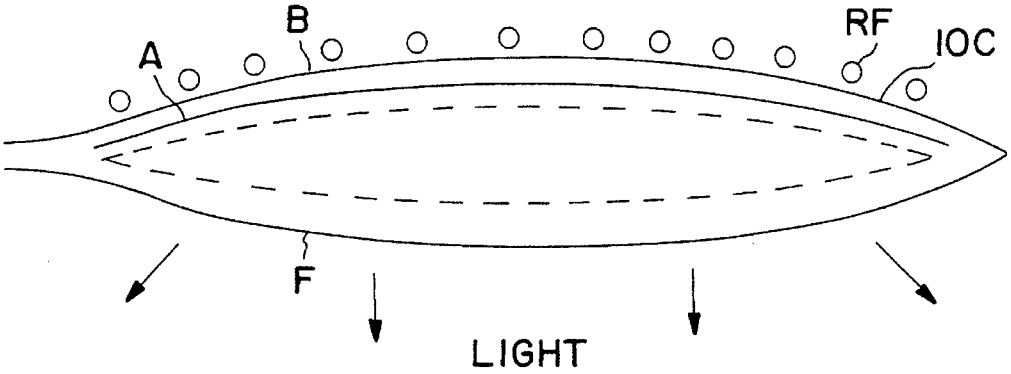
Figure 2D:
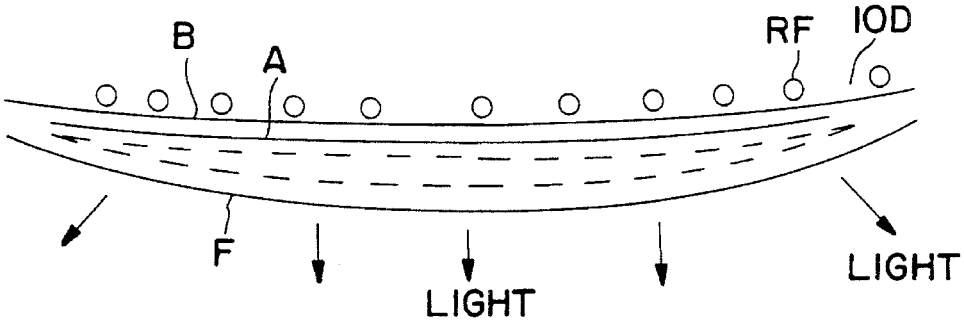

FIGS. 1A–1B show the preferred embodiment of the invention where "a" is any one of the arbitrary linear dimensions of an area of a back face "b" or front face F of a flat lamp vessel 10, and "b" being the average thickness or height of the lamp. The preferred embodiments of the present invention involve aspect ratios (a/b) of 2.0 or greater (where a and b are averages). Typically the aspect ratio will be 10.0 or higher. Each lamp has an rf coil RF and a getter source G. FIGS. 2A–2D show the lamps of the preferred embodiments of the invention, each having a back wall B, a front wall F. Each has wall portions with phosphor coatings P and $Al_2O_3$ coatings A (or other UV, and visible light reflecting material).

FIGS. 2A–2D assume a circular area of front and back faces. But in each case the area could be other shapes such as square, rectangular, etc. Further, either or both of the front or back faces can have some protrusions or reentrants relative to an otherwise generally flat or smooth curve (or compound curve area).

EXAMPLE

Figure 4A:
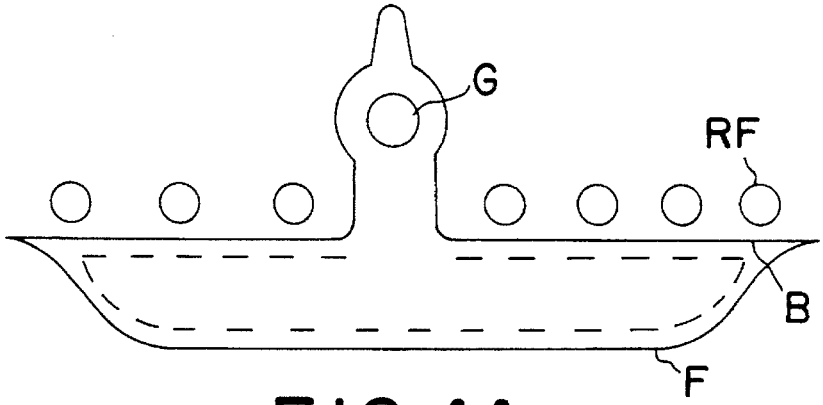
FIG. 4A shows a possible place for placement of a getter or getter mercury dispenser combination in any of the foregoing embodiments.
Figure 4B:
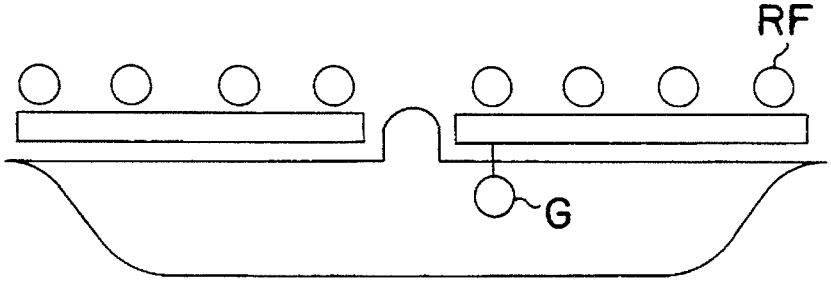
FIG. 4B shows an alternate location internal to the lamp of the getter/mercury dispenser.

One of the preferred embodiments of the invention was made by assembling two slightly domed pieces of Pyrex glass 1 mm wall thickness into a circular vessel 100 mm in diameter and about 15 mm thick as shown in FIG. 1. The flatter piece, which acted as the back wall B, was coated with $Al_2\mathbf{0}_3$ powder A and baked at 450° C. for about one hour. Then both pieces were phosphor spray coated utilizing triphosphor mixture commonly found in CFL's. After drying the phosphor was baked for about one hour and subsequently the two halves sealed into a vessel. The vessel was provided with an SAES Getters Co. St101 getter dispenser external to the lamp as shown in FIG. 4A (internal getters as shown in FIG. 4B are also contemplated in this invention). The vessel was evacuated and processed according to well established practices of fluorescent lamp making. Then the vessel was tipped off and the mercury released via an induction heater which released several mg's of mercury into the vessel. The lamp had about 0.5 torr of Kr gas fill in it. Additional models were made ranging from 0.1 to several torrs of Kr, Xe, Ar and mixtures thereof. Starting of the basic lamp (and the other models) was instant as soon as the appropriate RF power was applied to the coil, i.e. 5 to about 50 W at 13.56 MHz. The lamp(s) did operate very well at other frequencies as well. There was no need to use external starting aid in any of the lamps. Lamps start typically at a few watts of RF power with coil current of ≈1.5 A and RF voltage of 80–100 V. During operation, the measured reflected power was typically about 2%. The coil current and voltage were 1.2–1.5 A and 110–130 V at RF power of 20 W.

Figure 4C:
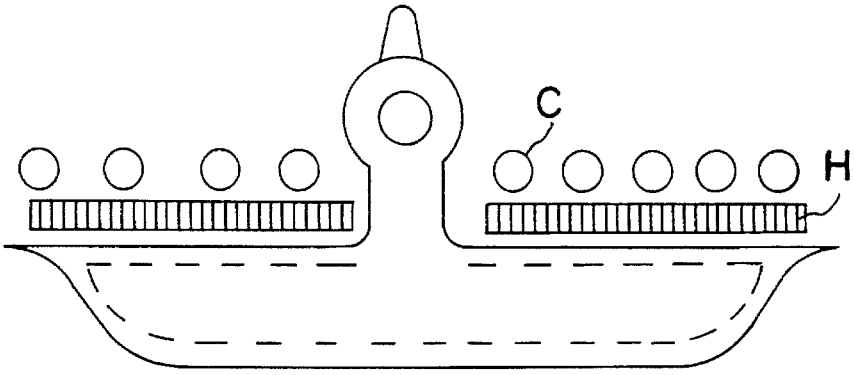
FIG. 4C shows possible deployment of a heat shield to keep the coil cooler. This can be made out of any heat insulating material.

After running for some time it is found that the coil adjacent to the lamp becomes hot while the leads to the coil are cold, this would indicate that the heat is primarily due to heat conduction from the lamp to the coil and not power loss (I2R) in the coil itself. Therefore by introducing a heat insulating thin layer H such as shown in FIGS. 4B and 4C, the temperature can be reduced considerably. A layer of Teflon film of 1.5 mm. thickness ms sufficient for this purpose.

Figure 5:
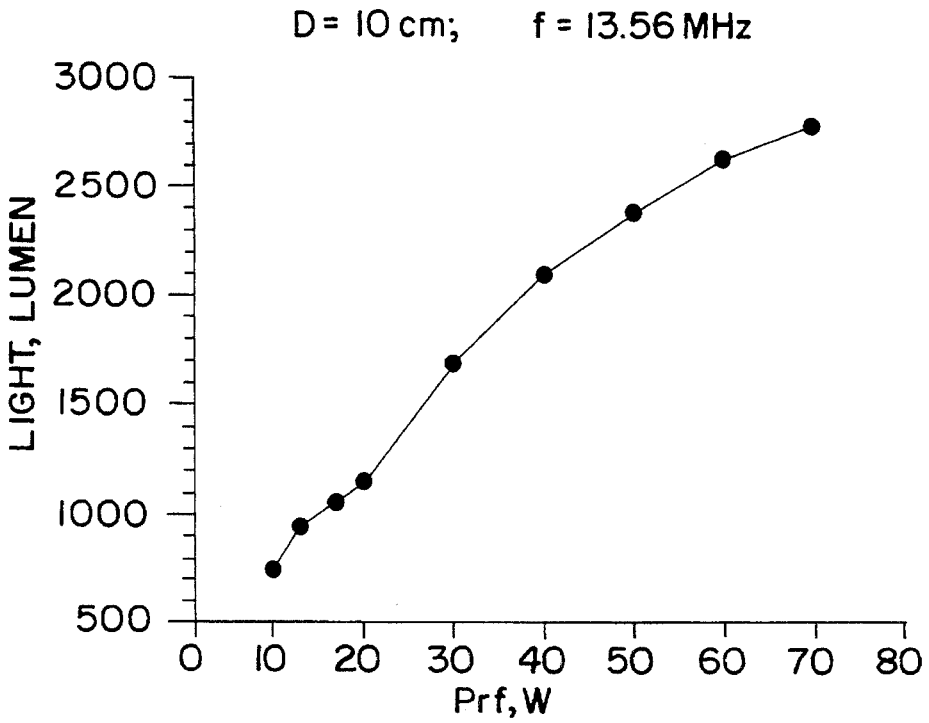
FIGS. 5 through 7 are various graphical representations that relate to the performance of such a lamp for specified diameter flat lamps.
Figure 6:
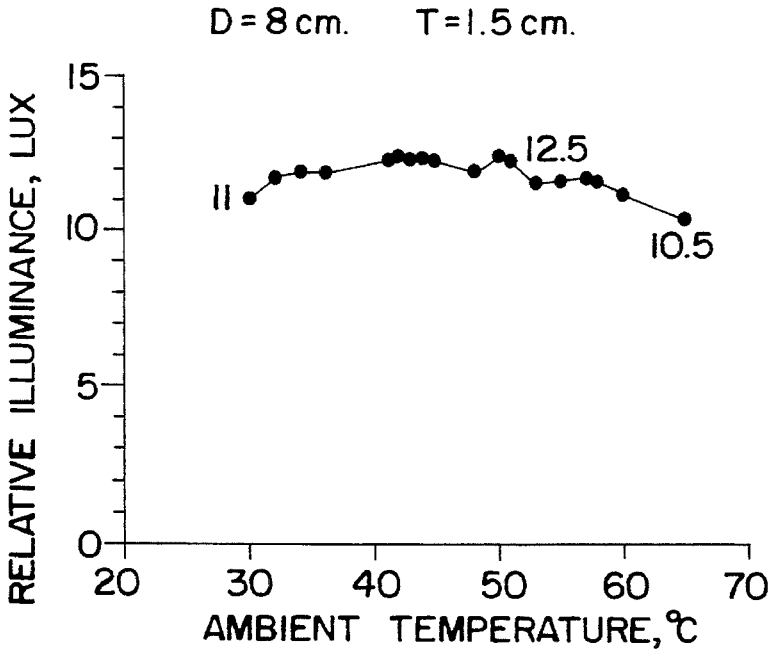
Figure 7:
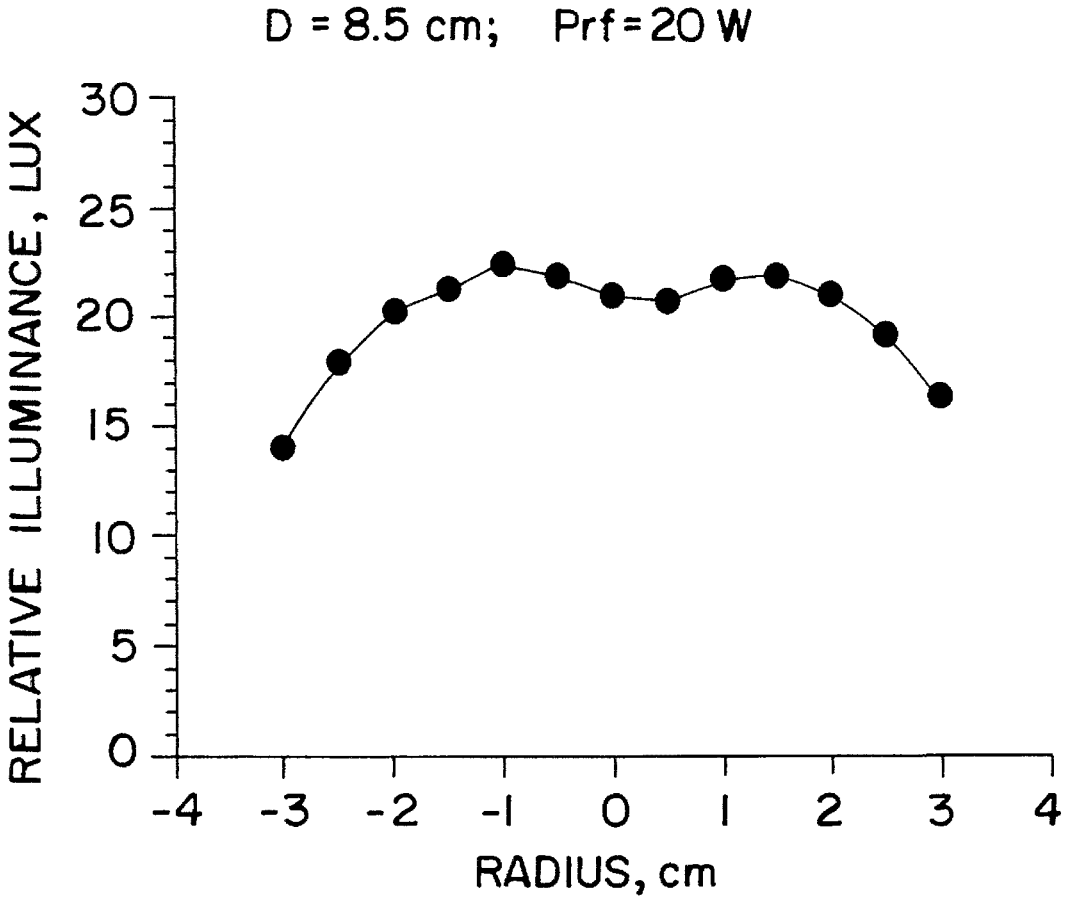

The coils for 8 and 10 cm diameter lamps had 5 turns. (Certainly lamps with other dimensions and shapes might have a different number of turns. ) The $I^2R$ losses in induction coil and reflected power in most cases did not exceed 10% for system power of 20–25 W. FIGS. 5 through 7 are referred to for the performance of the preferred embodiment.

FIG. 5 shows the total light output (lumens) versus the coupled rf power (Prf) in Watts (W) into the lamp of 10 cm. diameter (D) at a frequency (f) of 13.56 MHz. As can be seen from the figure, the lamp luminescence continues to increase from about 10 watts to 70 watts on a regular monotonic basis.

In FIG. 6, as can be seen, the relative luminescence (lux) versus the ambient temperature is shown (for a flat lamp of 8 cm. diameter,and 1.5 cm. thick). Here, it is seen that between 30° C. and 65° C. the luminescence appears to be relatively constant. This is characteristic of a flat lamp versus the bulbous approach where the resonance trapping is much more effective. In most compact fluorescent bulbs, as one increases the temperature one sees declining luminescence. However as the walls of the vessel get shallower (that means a high aspect ratio) the resonance trapping is reduced, one can go to higher densities of Hg and the sensitivity to temperature declines. Therefore for a practical application of ambient temperatures somewhere between 30° C. and 60° C. the luminescence is practically constant. This is one of the major advantages of such a lamp.

FIG. 7 shows the radial distribution of the relative luminescence as a function of the radius (cm). Here also, for the particular lamp (8.5 cm. diameter, rf power in=20 watts) where the measurements were made, the radial distribution of relative luminescence appears to be very constant all the way up to 75%–80% of the radius. This is also another advantage to the flat lamp approach which enables it to be used in a variety of applications.

End of Example

The light source, when placed on the ceiling or flush against a wall, can give a very uniform and bright illumination that is very pleasing to the eye.

Figure 3A:
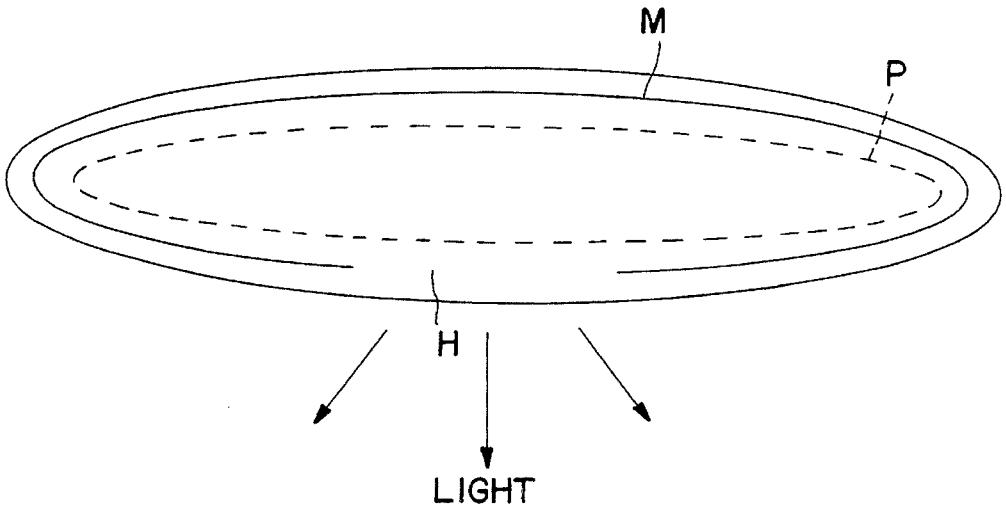
FIGS. 3A–3B show the construction of the lamp for particular accent lighting schemes.
Figure 3B:
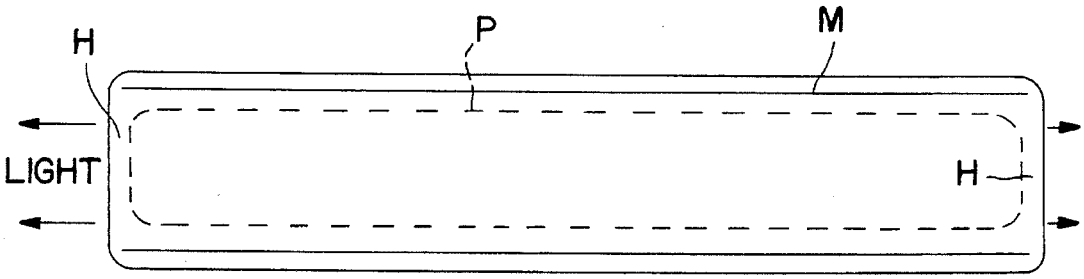

It is also within the scope of the present invention to cover all surfaces with a reflecting material M except a small hole H (or holes) on one surface and/or at the side edge(s) of the flat light source as shown in FIGS. 3A and 3B. This could be used as a bright spot light or accent edge illumination etc.

It is important to note that one of the basic advantages of the present invention is the fact that substantially most of the radiation is emitted in one or two directions. This results in higher illumination of the particular surface where light is desired. Therefore, compared to other compact fluorescent light sources, this source is more effective. Put in other words, for the same light source efficacy and the same illumination level, the flat inductively coupled light source would require fewer watts to sufficiently illuminate a given area. As a result, this source could be considered as more energy efficient than its counterparts.

Moreover, since the light source is relatively insensitive to ambient temperatures, due to dramatically reduced resonance trapping phenomenon, one does not need to have a large fixture, or an expensive ventilated fixture to bring about the optimum performance of the light source. For example, a small less expensive fixture could be utilized without fear that the light source performance would suffer due to heat buildup. As already demonstrated in FIG. 6, the performance does not seem to deteriorate up to an ambient temperature of about 70° C., and this is without using an amalgam of mercury! This is in sharp contrast with regular compact fluorescent or other electrodeless lamps where beyond about 25°–30° C. ambient temperature, the performance starts deteriorating. Therefore, it is clear that this approach lends itself to a very efficient fixture-light source combination of long life nature that could find many potential applications.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A fluorescent lamp device comprising:

(a) a substantially flat, vacuum fight glass vessel having an aspect ratio of greater than about 2 filled with a gas at pressure below 300 Torr and having at least a portion of its interior walls coated with $Al_2O_3$ or other diffuse reflecting material and some surface portions coated with only phosphor or phosphor on top of said diffuse reflecting layer; and (b) means for providing and inductively coupling RF energy into the gas mixture to generate light efficiently, the frequency of the RF being from 30 KHz to 915 MHz.

2. A fluorescent lamp device as set forth in claim 1 wherein said vessel has a flat, back surface, and wherein said means for providing RF energy includes an energizing coil which also assuming such flat shape for efficient coupling of the energy.

3. A fluorescent lamp device as set forth in claim 1 wherein said vessel has a slightly concave back surface, and wherein said means for providing RF energy includes an energizing coil which also takes such concave back shape for efficient coupling of the energy.

4. A fluorescent lamp device as set forth in claim 1 wherein said vessel has a convex back surface, the energizing coil also assuming such shape for efficient coupling of the energy.

5. A fluorescent lamp device as set forth in claim 1 wherein said vessel has a back surface and wherein said means for providing and coupling RF energy is positioned adjacent to said back surface and has a structure which provides radially and azimuthally uniform plasma in the vessel and light in such a manner that a surface at a given distance is illuminated, said vessel having a wider range of ambient temperature for optimum performance of light output due to its intrinsically less sensitive nature to ambient temperature when compared to other electrodeless or electroded compact fluorescent light sources.

6. A fluorescent lamp device as set forth in claim 1 wherein said vessel having insulating means between the means for providing and coupling RF energy and back surface.

7. A fluorescent lamp device as set forth in claim 1 further comprising at least a portion of said interior and exterior of the vessel wall through which light emerges is free of any coating.

8. A fluorescent lamp device as defined in claim 1 wherein the relative illuminance, lux, varies from about 10.5 to 12.5 over an ambient temperature range of about 30° C. to about 65° C.

9. A fluorescent lamp device as defined in claim 1 wherein said vessel has a back surface inside said vessel coated with $Al_2O_3$ or other diffuse reflecting material such that substantially all the emitted light is substantially directed in one direction through said opposing flat surface.

* * * * *